US006536591B2

(12) United States Patent
Huang et al.

(10) Patent No.: US 6,536,591 B2
(45) Date of Patent: Mar. 25, 2003

(54) CARRIER FOR ROLLS OF METAL PLATE

(75) Inventors: Kun Jung Huang, Taipei (TW); Shao Hua Liu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 121 days.

(21) Appl. No.: 09/745,049

(22) Filed: Dec. 20, 2000

(65) Prior Publication Data

US 2002/0045025 A1 Apr. 18, 2002

(30) Foreign Application Priority Data

Oct. 17, 2000 (TW) ..... 89217978 U

(51) Int. Cl.[7] ..... B65D 85/66
(52) U.S. Cl. ..... 206/397; 206/389; 294/67.2
(58) Field of Search ..... 206/303, 389, 206/397, 408; 242/159, 160.1, 160.4, 170, 597.5; 294/67.2, 67.1; 414/785

(56) References Cited

U.S. PATENT DOCUMENTS 1,591,248 A * 7/1926 Tracy ..... 294/67.2
2,680,644 A * 6/1954 Marconi ..... 294/67.21
2,816,792 A * 12/1957 Dixon ..... 294/67.2
2,987,339 A * 6/1961 Kaplan et al. ..... 294/67.2
4,245,861 A * 1/1981 Harry et al. ..... 294/67.2
D267,520 S * 1/1983 Main ..... D3/30.1
4,717,188 A * 1/1988 Johnston ..... 294/67.2
4,784,419 A * 11/1988 Jensen et al. ..... 294/67.2
6,131,975 A * 10/2000 Simpson ..... 294/67.2

* cited by examiner

*Primary Examiner*—Jim Foster
(74) *Attorney, Agent, or Firm*—Wei Te Chung

(57) ABSTRACT

A carrier (10) for carrying a roll of metal plate includes a frame (20), a support plate (40), a shield (60), and a flexible cushion (80). The frame includes a base (22) and a beam (24). The support plate is attached to the base and has an arcuate outer surface, for providing maximum contact area between the carrier and a center hole of the roll. The shield is attached to the beam, for preventing a side of the roll from being damaged by the beam. The cushion is attached to the support plate, for preventing surface damage to the roll. A plurality of ribs (44) is welded to the base, for reinforcing the support plate.

8 Claims, 2 Drawing Sheets

CARRIER FOR ROLLS OF METAL PLATE

BACKGROUND OF THE INVENTION

1. Field of the Invention

The present invention relates to a carrier, and more particularly a carrier which is used to carry rolls of metal plate.

2. Prior Art

In a variety of manufacturing industries, many metal plates are used. Generally, the size of the plates is great. This makes transportation of the plates difficult. Therefore metal plates are wound into rolls for facilitating transportation. Various carriers are used to move rolls of metal plate.

A conventional carrier includes a forklift, a base, and a boom. The base is inserted into a center hole of a roll of metal plate, whereupon the roll is carried from one place to another.

However, the base of the carrier is conventionally elongated, and the contact area between the base and the roll of metal plate is minimal. The sheer weight of the roll itself frequently results in its deformation. Additionally, the base is frequently uneven, rendering the roll prone to surface damage.

An improved carrier which resolves the above-mentioned problems is desired.

SUMMARY OF THE INVENTION

Accordingly, an object of the present invention is to provide a carrier for rolls of metal plate which prevents the rolls from being damaged.

To achieve the above-mentioned object, a carrier in accordance with the present invention includes a frame, a support plate, a shield, and a flexible cushion. The frame includes a horizontal base and a vertical beam. The support plate is attached to the base and has an arcuate outer surface, for providing maximum contact area between the carrier and a center hole of a roll of metal plate. The shield is attached to the beam of the frame, for preventing a side of the roll from being damaged by the beam. The cushion is attached to the support plate, for preventing surface damage to the roll. A plurality of ribs is welded to the base, for reinforcing the support plate.

Other objects, advantages and novel features of the present invention will be drawn from the following detailed embodiment of the present invention with attached drawings, in which:

DETAILED DESCRIPTION OF THE PREFERRED EMBODIMENT

Figure 1:
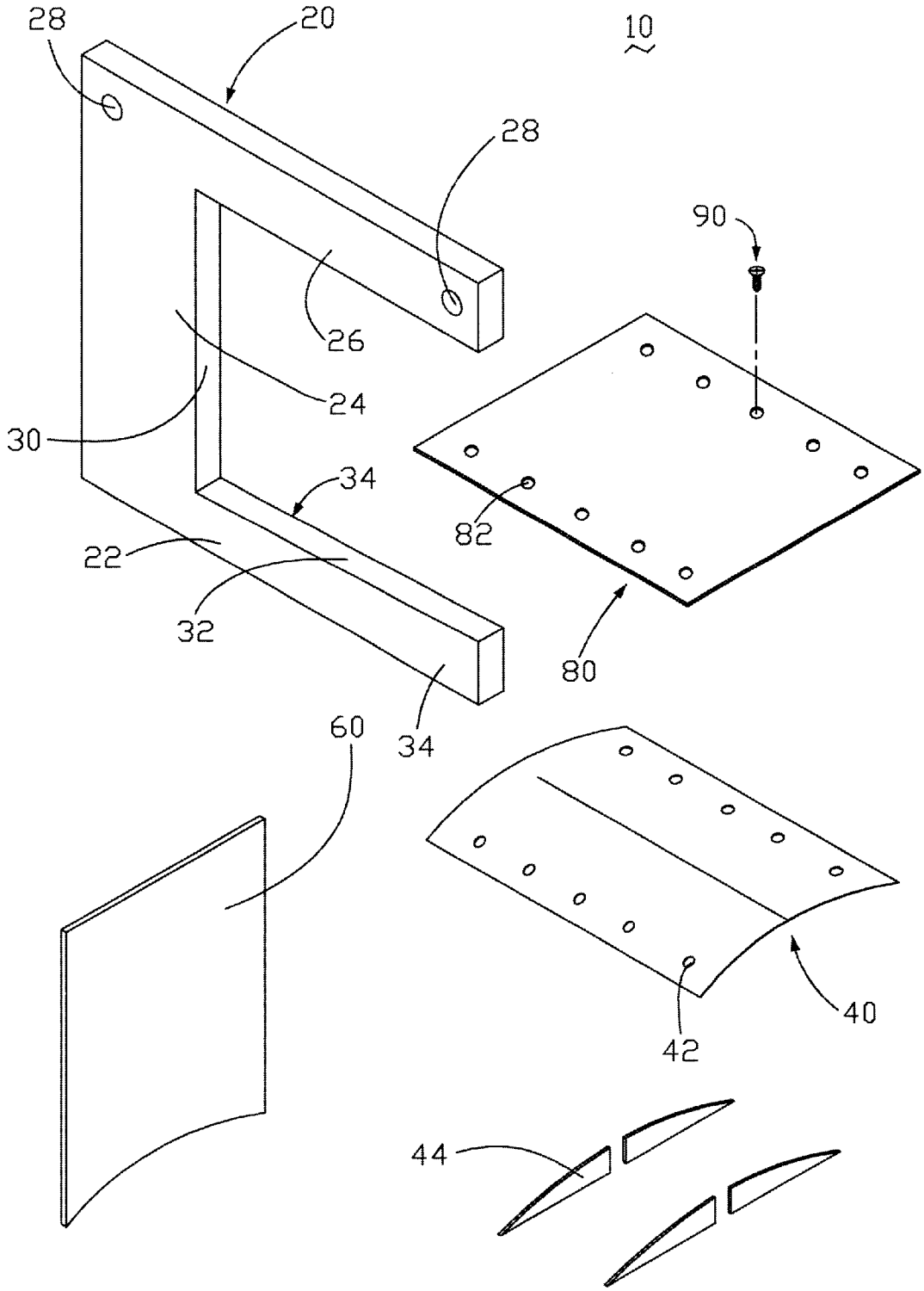
FIG. 1 is an exploded view of a carrier in accordance with the present invention.

FIG. 1 shows a carrier 10 in accordance with the present invention. The carrier 10 includes a frame 20, a support plate 40, a shield 60, a flexible cushion 80, and a plurality of screws 90.

The frame 20 is generally C-shaped, and includes a horizontal base 22, a vertical beam 24, and a horizontal boom 26. The base 22 and the boom 26 extend perpendicularly in the same direction from respective opposite top and bottom ends of the beam 24. The base 22 includes a top surface 32 and a pair of side surfaces 34. The top surface 32 is sloped slightly upwardly from the beam 24 to a free end of the base 22, for preventing a roll of metal plate (not shown) from sliding off the carrier 10 during normal transportation. The beam 24 includes an inner flank 30 between the boom 26 and the base 22. The boom 26 defines a pair of openings 28 at opposite ends thereof. The openings 28 engage with hooks (not shown) for carrying the rolls.

The support plate 40 is welded to the top surface 32 of the base 22, for bearing the roll. The support plate 40 has an arcuate outer surface, wider than the base 22 of the frame 20, and dimensioned to accord with the size of a center hole of the roll. A plurality of aligned screw holes 42 is defined at respective opposite longitudinal sides of the support plate 40. A plurality of ribs 44 underpins the support plate 40.

The shield 60 is planar, and has a concave bottom edge (not labeled). The radius of the bottom edge corresponds to the radius of the arc of the support plate 40. The shield 60 has a larger area than the flank 30.

The cushion 80 is made of a flexible cushioning material such as rubber, for preventing the roll from being damaged. The cushion 80 is bent to be arcuate, to cover the support plate 40. A plurality of bores 82 is defined at respective opposite longitudinal sides of the cushion 80, corresponding to the screw holes 42 of the support plate 40. Screws 90 attach the cushion 80 to the support plate 40.

Figure 2:
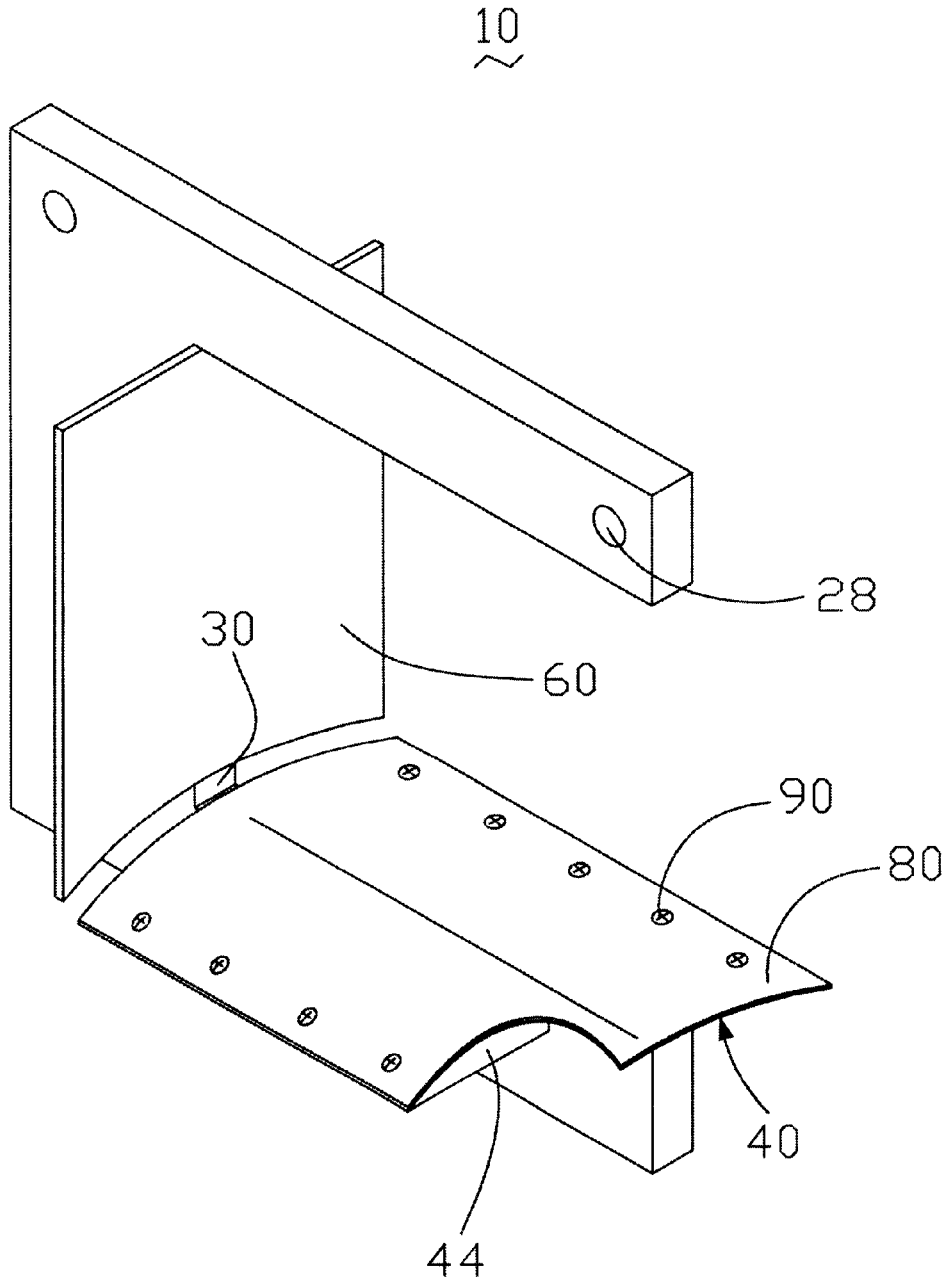
FIG. 2 is an assembled view of FIG. 1, with part of a support plate of the carrier cut away to show greater detail.

Referring also to FIG. 2, in assembly, the shield 60 is welded to the flank 30 of the beam 24 according to a predetermined distance defined between the bottom edge of the shield 60 and the top surface 32 of the base 22. The support plate 40 is attached to the top surface 32 of the base 22. The ribs 44 are symmetrically aligned perpendicular to respective opposite side surfaces 34 of the base 22, such that top edges of the ribs 44 contact a bottom surface of the support plate 40. The ribs 44 are then welded to the side surfaces 34 of the base 22. The cushion 80 is then attached to the arcuate outer surface of the support plate 40 with the screws 90.

In operation of the carrier 10, the base 22 with the support plate 40 thereon is inserted into the center hole of the roll. The shield 60 prevents a side of the roll from being damaged by contact with the flank 30 of the beam 24. When the carrier 10 moves the roll, the cushion 80 of the support plate 40 abuts inmost metal plate of the roll. A large contact area between the cushion 80 and the inmost metal plate is established. This results in minimal force per unit area operating between the cushion 80 and the inmost metal plate. The roll is thereby protected from any deformation which might otherwise occur by means of its own weight. Moreover, the cushion 80 prevents surfaces of the inmost metal plate from being damaged. The ribs 44 enhance the support capability of the support plate 40. Thus the roll can be safely carried about without being damaged.

It is understood that the invention may be embodied in other forms without departing from the spirit thereof. Thus, the present example and embodiment is to be considered in all respects as illustrative and not restrictive, and the invention is not to be limited to the details given herein.

We claim:

1. A carrier for carrying a roll of metal plate having a hole defined therethrough, comprising:

a frame comprising a base adapted to extend into the hole of the roll and a beam extending in an upward direction from the base for abutting against the roll;

a support plate attached to the base of the frame, the support plate having an arcuate outer surface adapted to contact an inner surface of the metal plate; and a shield attached to the beam for preventing the roll from being damaged by the beam, the shield having an arcuate bottom edge corresponding to the arcuate outer surface of the support plate.

2. The carrier as recited in claim 1, wherein a flexible cushion is attached to the arcuate outer surface of the support plate, for preventing the roll from being damaged.

3. The carrier as recited in claim 2, wherein the support plate defines a plurality of screw holes, the cushion defines a plurality of bores corresponding to the screw holes, and a plurality of screws extends into the bores and the screw holes for attaching the cushion to the support plate.

4. The carrier as recited in claim 1, wherein at least one rib is attached to the base of the frame, for supporting the support plate.

5. The carrier as recited in claim 1, wherein a top surface of the base of the frame is sloped upwardly from the beam to a free end of the base, for preventing the roll from sliding off the carrier.

6. The carrier as recited in claim 1, wherein the frame further comprises a boom extending from the beam and adapted for carrying the roll.

7. The carrier as recited in claim 6, wherein the boom defines a pair of openings at opposite ends thereof, and wherein the boom and the base extend from the beam in substantially the same direction.

8. A carrier for carrying a roll of metal plate having a hole defined therethrough, comprising:

a frame comprising a base adapted to extend into the hole of the roll and a beam extending in an upward direction from the base for abutting against the roll, a top surface of the base of the frame sloped upwardly from the beam to a free end of the base for preventing the roll from sliding off the carrier;

a support plate attached to the base of the frame, the support plate having an arcuate outer surface adapted to contact an inner surface of the metal plate; and a shield attached to the beam for preventing the roll from being damaged by the beam.

* * * * *